United States Patent [19]

Galer

[11] 4,386,701

[45] Jun. 7, 1983

[54] TIGHT HEAD PAIL CONSTRUCTION

[75] Inventor: Herbert W. Galer, Pine Township, Allegheny County, Pa.

[73] Assignee: United States Steel Corporation, Pittsburgh, Pa.

[21] Appl. No.: 845,097

[22] Filed: Oct. 25, 1977

Related U.S. Application Data

[63] Continuation of Ser. No. 588,453, Jun. 19, 1975, abandoned, which is a continuation of Ser. No. 383,002, Jul. 26, 1973, abandoned.

[51] Int. Cl.[3] ..... B65D 21/02

[52] U.S. Cl. ..... 206/509; 206/508; 206/510; 215/1 C; 215/10; 222/143

[58] Field of Search ..... 206/509, 510, 508; 215/10, 1 C; 222/143

[56] References Cited

U.S. PATENT DOCUMENTS

| | | | |
|---|---|---|---|
| 2,661,872 | 12/1953 | Trautuetter | 222/143 |
| 2,775,364 | 12/1956 | Inden | 206/509 |
| 2,978,142 | 4/1961 | Novick | 206/508 |
| 3,001,564 | 9/1961 | Hopkins | 215/10 |
| 3,207,359 | 9/1965 | Heisler | 206/509 |
| 3,369,688 | 2/1968 | Dike | 222/143 |
| 3,387,749 | 6/1968 | Godshalk | 222/143 |
| 3,623,634 | 11/1971 | Norguard | 206/509 |
| 3,701,455 | 10/1972 | Warmecke | 206/509 |

FOREIGN PATENT DOCUMENTS

| | | | |
|---|---|---|---|
| 572551 | 10/1945 | United Kingdom | 206/508 |
| 1368805 | 10/1974 | United Kingdom | 206/509 |

*Primary Examiner*—George E. Lowrance
*Attorney, Agent, or Firm*—William L. Krayer

[57] ABSTRACT

Blow molded, tight head plastic containers are provided with interlocking means in the form of a groove on the top section of the container, a tongue on the bottom section of the container and a peripheral rim about the top section of the container. When similar containers are stacked upon one another, this construction permits the stack to remain vertically aligned even when it is tilted to angles of 45° to the vertical.

11 Claims, 7 Drawing Figures

TIGHT HEAD PAIL CONSTRUCTION

This is a continuation of application Ser. No. 588,453, filed June 19, 1975, now abandoned, which was a continuation of Ser. No. 383,002, filed July 6, 1973, now abandoned.

BACKGROUND OF THE INVENTION

Blow molded, tight head plastic containers are used to transport industrial chemicals. Commonly, the plastic material is polyethylene, and the containers have a capacity of five or six gallons. The industrial chemicals are typically aqueous dispersions or solutions of synthetic polymers, pickling brines, alkali cleaners, etc. When these containers are filled, they are generally stored by stacking one container upon the other, and the stack is generally supported by pallets. The stacks will often have four or more containers one upon the other. Slight upsets or misalignment during the storage of these stacked containers often causes tilting of the stack. This tilting may cause the entire stack to fall apart and can possibly lead to spillage of the contents of the individual containers. Desirably, stacks of containers should be able to remain integral even though they do suffer some tilt.

OBJECTS OF THE INVENTION

It is among the objects of this invention to improve containers and assemblies of containers which are of the tight head type and made from thermoplastic resins so that one container will interlock with another similar container to maintain the integrity of assemblies of such containers. It is another object of this invention to improve such container by incorporating into the container structure itself configurations that will improve the interlocking of one container with another. Furthermore, another object of this invention is to provide such configurations that can be easily adapted to the ordinary manufacturing process of blow molding for such containers. Another object of this invention is to provide such configurations that will allow for interlocking even though the manufacturing tolerances of such containers allow a considerable variation in shape and dimension from one container to another. These and other objects as set forth in the following description of the invention are equally within the scope of this invention.

DESCRIPTION OF THE INVENTION AND FIGURES

The plastic containers of this invention have an integral groove in their top section with a peripheral upstanding rim and a peripheral tongue in a recessed bottom section so to provide interlocking between adjacent containers when stacked one upon another.

This invention applies to plastic containers of the tight head type. Generally, these are structures having a top integral with side walls and bottom and in which there is a relatively small pour opening in the top. These structures are typically made by blow molding, the container is formed from a parison of plastic material and this is expanded by a gas to form shapes corresponding to the mold surfaces of an external mold. By this means, thermoplastic resins such as high density polyethylene can be readily processed at relatively low molding pressures into tight head containers. However, in cooling of the hot plastic container when it has been molded, distortions and variations in the shape and dimension of the container occur. Pour openings are formed in the container by cutting small openings through the wall of molded plastic product. Suitable closures and handles are fitted to the container and it is ready to serve as a device for transporting liquids. The plastic material will generally be a thermoplastic resin, and is commonly high density polyethylene.

Figure 1:
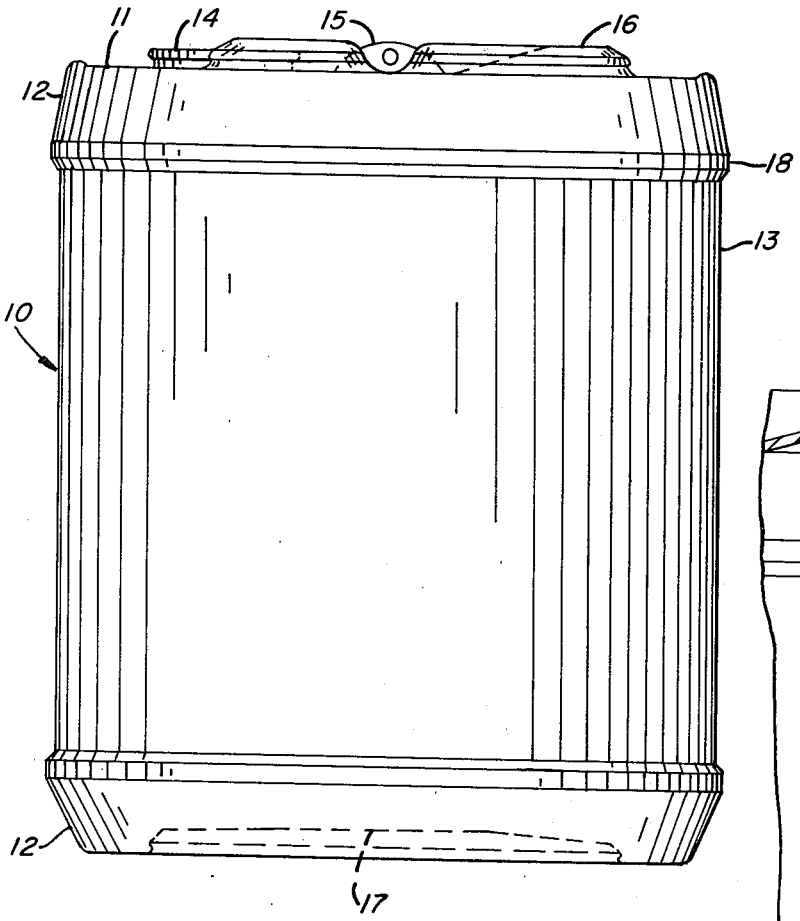
FIG. 1 is an elevation of a plastic container according to the invention.
Figure 2:
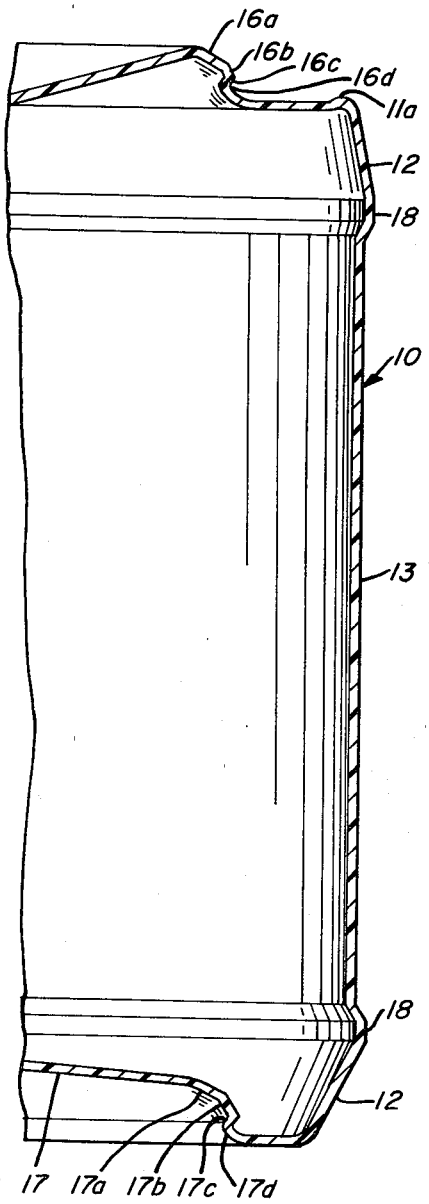
FIG. 2 is a partial cross-section of the elevation shown in FIG. 1.
Figure 3:
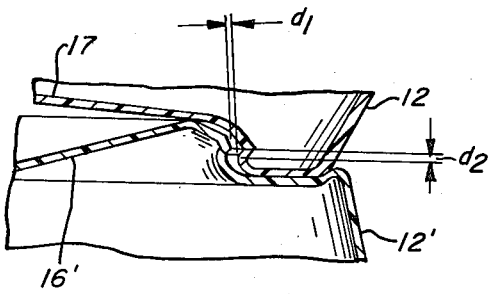
FIG. 3 is a partial elevation and cross-section showing the interlocking between similar containers.

A container embodying the principle of this invention is shown in FIGS. 1–3. The container (10) is a one-piece blow molded plastic article. It has a top section (11), a side wall section (13), and a bottom section (17). The container is generally of cylindrical shape and in the top section (11) there is an eccentric pour opening (14). Convolutions (16) are formed integral with the walls of top section (11) to define upstanding members. The outer side wall of the upstanding member has adjacent to the horizontal surface of the top section a groove (**16*d*); adjacent to this groove, there is a first upwardly and inwardly inclined surface (16*b*). This surface joins a second upwardly and inwardly inclined surface (16*a*). The intersection of the groove (16*d*) and the first adjacent surface (16*b*) is shown as (16*c*). There is a peripheral rim (11*a*) about the top section (11). Generally, a handle housing (15) is provided in the top section of the container. This housing (15) generally has openings for the insertion of handle bars. A preferred construction of the container has side walls (13) with adjacent inwardly tapered sections (12). Ribs (18) provided at the intersection of inclined surfaces (12) and side walls (13) strengthen the side walls and facilitate rolling the container on its side. The combination of inclined surfaces (12) and straight side walls (13) permits controlling the distribution of plastic material along the profile of the container. This has been described in my application Ser. No. 161,755 now abandoned. The bottom section of the container (17) has a central recess adapted to receive the upstanding members of the top section (11) of the similar container. The interior side wall of the recess is provided with a tongue (17*d*) and adjacent upwardly inclined surface (17*b*) which is joined to second upwardly and inwardly inclined surface (17*a*). The first upwardly inclined surface has a greater angle with the vertical than said second surface. The intersection between the tongue (17*d*) and the first adjacent surface (17*b*) is illustrated by (17*c***).

As shown in FIG. 3, a preferred construction of the containers according to this invention has a short horizontal distance (d1) between the apex of the tongue on the bottom section of a first container (17) and the mouth of the groove in the top section (16) of an adjacent container. It is also preferred to have a short vertical distance (d2) between the intersection of the groove and its first adjacent surface (**16*c*) and the intersection of the tongue and its first adjacent surface (17c) on an adjacent container. As shown in FIG. 3, the horizontal portion of the bottom section (17) is engaged between the rim (11a**) and corresponding tongue and groove section of adjacent containers. The horizontal and vertical spacings (d1 and d2) for the grooved constructions in the top section and the tongue construction in the bottom section cooperate with the peripheral rim to provide interlocking between containers even when the horizontal plane defining the top section and the horizontal plane defining the bottom section has significant deviations due to manufacturing tolerances.

The convolutions forming the upstanding members of the top section are an integral part of the surface defining the closed top section of the container. This is shown in FIG. 2 where the cross-section of the elevation through the top section shows the continuous wall of approximately uniform thickness defining both the top section and the side wall section. As shown in my abandoned application Ser. No. 161,755, the plan view of these containers generally has the pour opening disposed adjacent to the side wall of the container. The upstanding members also form a pour surface with the pour opening as is shown in my U.S. Pat. No. 3,794,201. As recited in the aforementioned U.S. Pat. No. 3,794,201 (col. 1, lines 61–66): "The closure and pour opening are shown adjacent to an edge of the body; the elevated portion . . . of the body forms a liquid retention area so that the pour opening and closure can form a pouring surface over the body edge." A preferred construction has the upstanding members arranged in semicircular segments terminating on each side of the pour opening. The segment opposite the pour opening will have an arc radius of approximately 140° . The two adjacent segments will have an arc radius of approximately 30° . These containers are generally of 5 or 6 gallon capacity. They will generally have an overall diameter of 11.5" and will be about 11.25" in length. The pour openings will have a diameter of approximately 2.17". In general, the dimensions will correspond to those described for the containers shown in my abandoned application Ser. No. 161,755.

Figure 4:
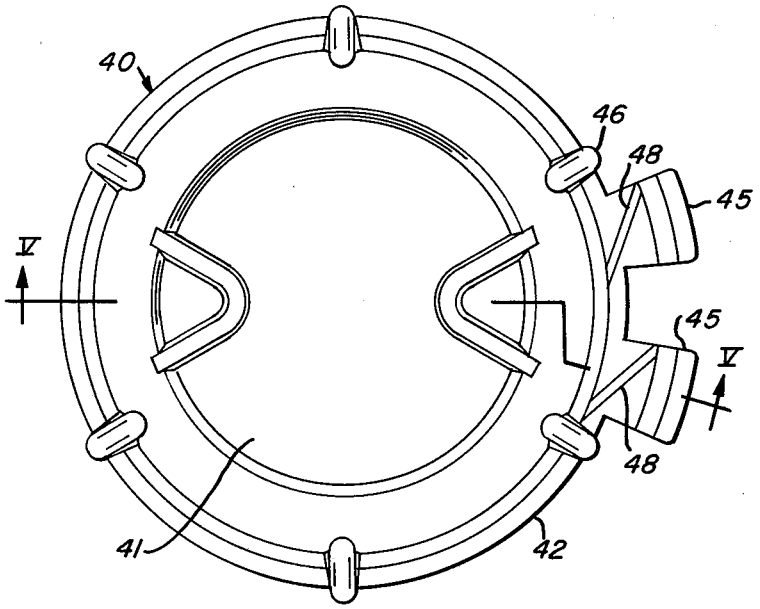
FIG. 4 is a plan view of a closure for the pour opening in the blow molded containers of this invention.
Figure 5:
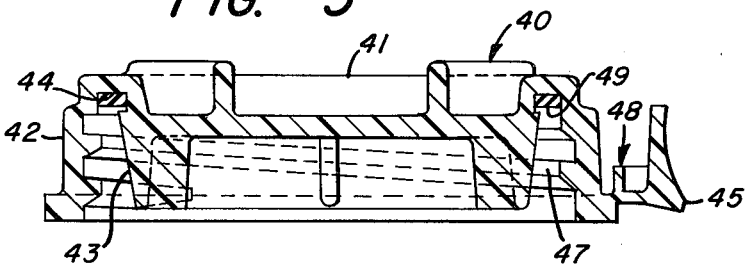
FIG. 5 is an elevation in cross-section of the closure of FIG. 4.
Figure 6:
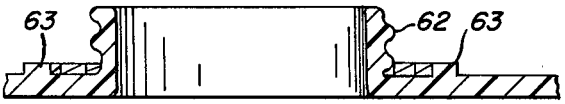
FIG. 6 is a partial elevation in cross-section of a pour opening for containers in the invention.
Figure 7:
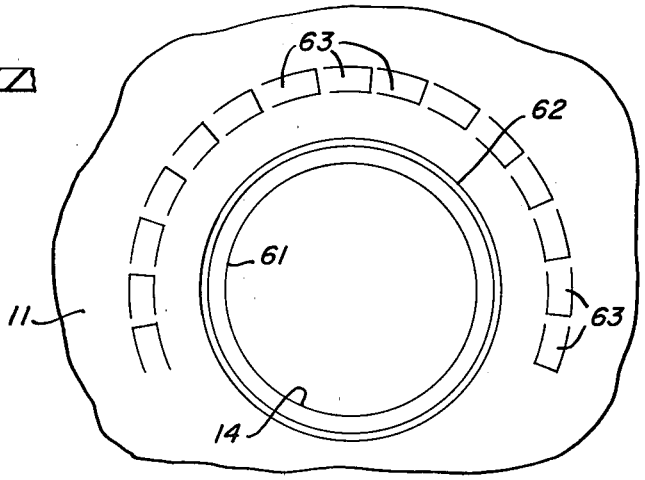
FIG. 7 is a plan view of the pour opening construction shown in FIG. 6.

The particular advantage of this invention is that the improved stackability of the container enhances the suitability of a securely closed container for the transportation of industrial fluids. As has been described in my U.S. Pat. No. 3,794,201 and my abandoned applications Ser. Nos. 161,755 and 230,260, the secure closing and ready release of the closure for the pour openings of this container have made it suitable for the transportation of corrosive fluids. Furthermore, the improved stackability of the containers of this invention is a particularly valuable feature when used with containers having ready release of the closure. FIG. 4 illustrates a preferred closure construction for the pour opening as shown in FIGS. 6 and 7. FIG. 5 is a cross-section of this closure construction. In FIG. 4, there is a thermoplastic closure (40) having a central pour opening and closing section (41) This closure has an outer wall (42) and an inner wall (43) connected by an annular section (44). The surface of this annular section is slightly inclined upwardly and outwardly. As well, the surface of the inner wall (43) is inclined upwardly and outwardly. Both of these have an angle of inclination of about 5°. The closure has threads (47) on the interior surface of its outer wall. These are adapted for engagement with a threaded spout (62) which encircles the pour opening (14). Disposed about the spout (62) are ratchet teeth (63). As shown in FIG. 7, these ratchet teeth are disposed in a circular segment about the pour opening which segment has an arc radius of about 300°. The section in which teeth have been omitted is where fluid is usually poured during pouring from the container. The closure has at least two pawls (45). These pawls are, as shown in FIG. 5, attached to the lower section of the outer wall of the closure. A resilient member (48) reinforces the springing action of the pawls. The closure itself is of integral, one-piece construction with the pawls. When the closure is screwed down upon the pour opening, at least one of the pawls will engage the ratchet teeth disposed about the pour opening. This permits a secure sealing of the container. Furthermore, when it is desired to release the closure from the container, the pawls are sprung back by finger pressure on their outer surfaces. It is easily manipulatable by one hand to both release the pawls from their engagement with the ratchet teeth and to unscrew the closure from the container. While this is a preferred form of pour opening and closure construction, and has been more fully explained in my U.S. Pat. No. 3,794,201, it is also feasible to use metal crimp closure constructions such as are common in these blow molded containers. When such crimped metal closure constructions are used, the pour opening simply has an upstanding wall with a relatively small rim at its top surface, this is shown in profile in FIG. 1.

The containers of this invention, when stacked together, have enough interlocking between the top and bottom sections of the adjacent containers so that the plurality of containers forming the stack can maintain axial alignment even when the stack is rotated through an angle up to 45° from the vertical. This is particularly important in the storage of filled containers when these containers are formed into stacks and loaded onto pallets and the pallets are loaded upon the containers forming the top row of stacks in the lower most pallet. When there is tilting among the stacks of containers, the advantages of this invention permit the stack to remain integral and prevents the collapse of such stacks.

This invention has been described in terms of a particular example, however, it should be clearly understood that the scope of this invention contemplates such changes in proportions, and selection of the material as would be deemed equivalent by one of ordinary skill in the art.

I claim:

1. In a tight head, blow molded, cylindrical, plastic container having a top section, a sidewall section and a bottom section, said top section having an eccentric pour opening, and convolutions in its surface to define upstanding members integral with said top section, said upstanding members cooperating with said pour opening to form a pour surface for said container, said bottom section having a central recess adapted to receive upstanding members on the top section of a similar container, the improvement comprising:

a groove in the outward portions of the upstanding members of said top section, a tongue in the interior sidewalls of said recess, and an upstanding rim about said top section, wherein said tongue, said groove, and said rim cooperate with each other to provide an interlocking connection between the top and bottom sections of similar containers when stacked one upon another so that said stack remains axially aligned when tilted through an angle of 45° to the vertical.

2. The container of claim 1 having said upstanding members in the form of semicircular segments arranged to define an annular section terminating at the sides of said pour opening.

3. The container of claim 2 wherein said segments comprise a semicircular segment having an arc radius of about 140°, and two adjacent segments having an arc radius of about 30°.

4. The container of claim 1 wherein said groove and said tongue are spaced apart a short horizontal distance.

5. The container of claim 1 having a top section with said groove at the base of the upstanding member, said groove joining a first upwardly and inwardly disposed surface, said first surface joining a second upwardly and inwardly inclined surface, said first surface being at a greater angle to the vertical than said second surface, and a bottom section with said tongue joining a first inwardly and upwardly inclined surface, said first surface joining a second inwardly and upwardly inclined surface, said first surface being inclined to the vertical at a greater angle than said second surface.

6. The container of claim 5 wherein said groove and said tongue are spaced apart a short horizontal distance.

7. The container of claim 5 wherein the intersection of said groove and its adjacent first surface is spaced a short vertical distance above the intersection of said tongue and its first adjacent surface.

8. The container of claim 6 wherein the intersection of said groove and its adjacent first surface is spaced a short vertical distance above the intersection of said tongue and its first adjacent surface.

9. In a combination of a plurality of tight head, blow molded, cylindrical, plastic containers, each said container being stacked one upon the other, each said container having a top section, a sidewall section, and a bottom section, said top section having an eccentric pour opening, and convolutions in its surface to define upstanding members integral with said top section, said upstanding members cooperating with said pour opening to form a pour surface for said container, said bottom section having a central recess adapted to receive upstanding members on the top section of a lower most adjacent container, the improvement comprising:

a groove in the outward portions of the upstanding members of said top section, a tongue in the interior sidewalls of said recess, and an upstanding rim about said top section, said groove, said tongue and said rim cooperating with each other to provide an interlocking connection between the top and bottom sections of adjacent similar containers so that said stack remains axially aligned when tilted through an angle of 45° to the vertical.

10. The combination of claim 9 wherein at least four containers are stacked one upon another.

11. The combination of claim 10 wherein said containers are filled with a liquid having a density approximately that of water.

* * * * *

UNITED STATES PATENT AND TRADEMARK OFFICE

CERTIFICATE OF CORRECTION

PATENT NO. : 4,386,701

DATED : June 7, 1983

INVENTOR(S) : Herbert W. Galer

It is certified that error appears in the above—identified patent and that said Letters Patent is hereby corrected as shown below:

Column 1, line 6, after "July" change "6" to -- 26 --.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*